United States Patent [19]

Kokolis et al.

[11] Patent Number: 4,794,987

[45] Date of Patent: Jan. 3, 1989

[54] SOLVENT FLOODING WITH A HORIZONTAL INJECTION WELL AND DRIVE FLUID IN GAS FLOODED RESERVOIRS

[75] Inventors: George P. Kokolis, Houston, Tex.; Kevin P. McCoy, Calgary, Canada

[73] Assignees: Texaco Inc., White Plains, N.Y.; Texaco Canada Resources, Calgary, Canada

[21] Appl. No.: 140,708

[22] Filed: Jan. 4, 1988

[51] Int. Cl.[4] ..... E21B 43/22

[52] U.S. Cl. ..... 166/274; 166/50; 166/305.1

[58] Field of Search ..... 166/274, 305.1, 268; 175/62; 166/50, 245

[56] References Cited

U.S. PATENT DOCUMENTS

| | | | |
|---|---|---|---|
| 4,086,961 | 5/1978 | Braden, Jr. et al. | 166/274 |
| 4,249,607 | 2/1987 | Allen | 166/274 |
| 4,501,326 | 2/1985 | Edmunds | 166/50 |
| 4,510,997 | 4/1985 | Fitch et al. | 166/50 |

*Primary Examiner*—Stephen J. Novosad
*Assistant Examiner*—Terry Lee Melius
*Attorney, Agent, or Firm*—Jack H. Park; Kenneth R. Priem; Harold J. Delhommer

[57] ABSTRACT

The invention is a method for recovering residual hydrocarbons from a reservoir which has been previously swept by gas. The invention steps comprise drilling and completing at least one horizontal injection well relatively near the top of the reservoir and relatively near a substantially vertically oriented boundary of the reservoir, drilling and completing at least one second injection well between the horizontal injection well and the vertical boundary of the reservoir, injecting a miscible solvent through the horizontal injection well to create a curtain of solvent falling through the previously gas swept reservoir, and injecting a drive fluid into the reservoir through the second injection well to drive the curtain of falling solvent horizontally through the reservoir. A production well is employed to produce hydrocarbons and other fluids that have been banked in front of the horizontally driven falling solvent curtain.

17 Claims, 1 Drawing Sheet

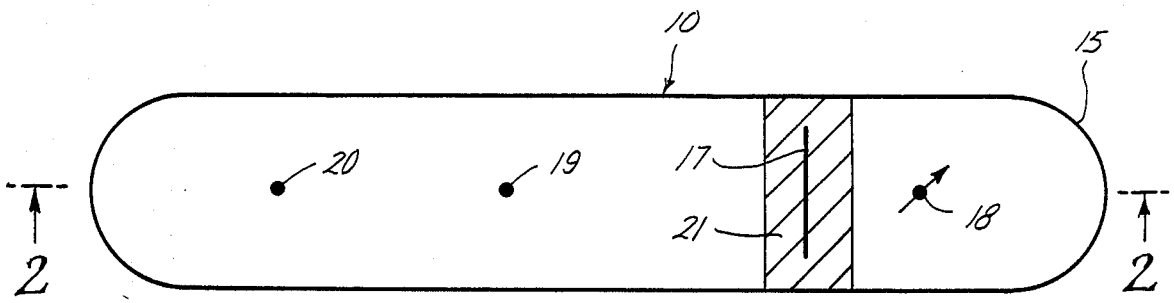
Fig. 1
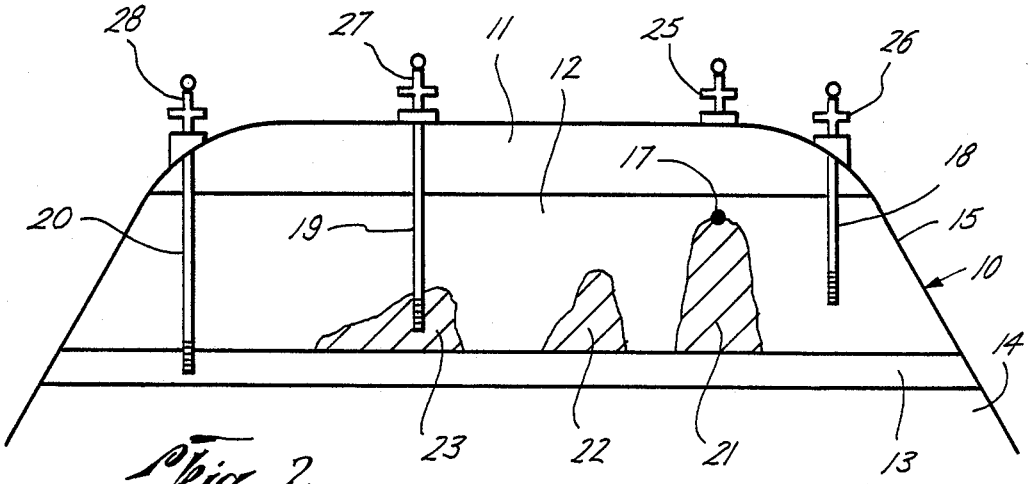
Fig. 2
Fig. 3
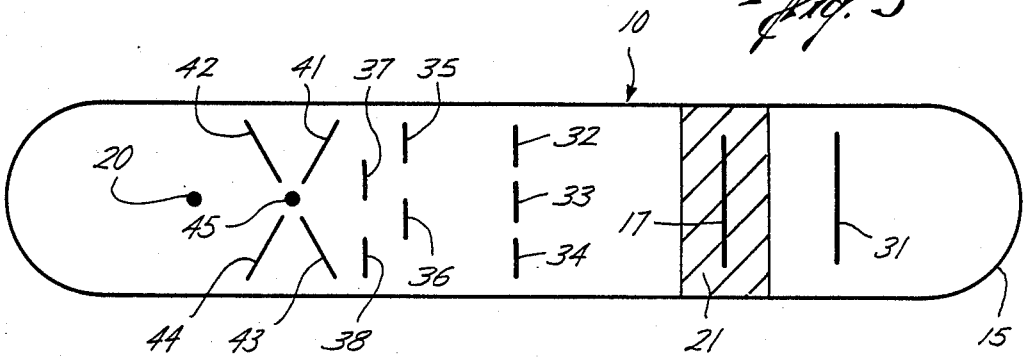

SOLVENT FLOODING WITH A HORIZONTAL INJECTION WELL AND DRIVE FLUID IN GAS FLOODED RESERVOIRS

BACKGROUND OF THE INVENTION

This invention concerns a method for recovering residual hydrocarbons with a miscible solvent flood from a reservoir which has been previously gas flushed. More particularly, the method employs at least one horizontal well to inject miscible solvent and at least one injection well to inject a drive gas to move the miscible solvent through the reservoir.

Horizontal wells have been investigated and tested for oil recovery for quite some time. At present, the use of horizontal wells is usually limited to formations containing highly viscous crude. In the future, horizontal wells will be used more widely for other types of formations. It seems likely that horizontal wells will soon become a chief method of producing tar sand formations and other highly viscous oils which cannot be efficiently produced by conventional methods because of their high viscosity. Most heavy oil and tar sand formations cannot be economically produced by surface mining techniques because of their formation depth.

Various proposals have been set forth for petroleum recovery with horizontal well schemes. Most have involved steam injection or in situ combustion with horizontal wells serving as both injection wells and producing wells. Steam and combustion processes have been employed to heat viscous formations to lower the viscosity of the petroleum as well as to provide the driving force to push the hydrocarbons toward a well.

A system of using parallel horizontal wells drilled laterally from subsurface tunnels into the lower portion of a tar sand formation is disclosed in U.S. Pat. No. 4,463,988. The described process injects a displacing means such as steam into the boreholes to cause hydrocarbons to flow into the lower portion of the lateral borehole and be produced to the surface.

U.S. Pat. No. 4,577,691 discloses a plurality of parallel horizontal wells arranged in a vertical plane whereby a thermal fluid can be injected into upper wells to drive hydrocarbons down from the area of the upper wells to the horizontal wells immediately below and lying in the same vertical plane. U.S. Pat. No. 4,700,779 discloses a pattern of four or more horizontal wells lying parallel to each other in a horizontal plane within a thin reservoir. The wells in a horizontal plane are used with a combination steam and water injection process to sweep oil from one end to the other end of the pattern.

The use of two or more parallel horizontal injection and production wells is disclosed in U.S. Pat. No. 4,598,770. In this reference, two horizontal wells are drilled parallel to each other at the bottom of the hydrocarbon formation. A thermal fluid is injected through one of the horizontal wells and that fluid and hydrocarbons are produced at the other parallel horizontal well. U.S. Pat. Nos. 4,385,662 and 4,510,997 have a disclosure similar to U.S. Pat. No. 4,598,770 except that a hydrocarbon solvent is injected and allowed to soak in a tar sand formation. Thereafter, a driving fluid such as water is injected to drive the formation fluids and solvent to the horizontal production well in U.S. Pat. No. 4,510,997. The method of U.S. Pat. No. 4,385,662 adds a second injection of solvent followed by a soak period before the drive fluid injection.

U.S. Pat. No. 4,022,279 discloses a system for conditioning an oil or gas formation by drilling horizontal spiralling holes from a vertical well. The patent teaches the injection of unnamed "stimulating fluids" into the spiralling wellbores to provide a way to stimulate bore formation area at a predetermined distance around the vertical well than a series of horizontal wells.

It is known that the use of horizontal injection wells increases the areal sweep of a miscible flood. An increase in areal sweep efficiency for miscible solvent floods has been noted for the use of horizontal injection wells over vertical point source injection wells. Please see Chen, S. M., Olynyk, J., "Sweep Efficiency Improvement Using Horizontal Wells Or Tilted Horizontal Wells In Miscible Floods," CIM Paper No. 85-36-62, Edmonton, Canada (June 2–5, 1985), pages 385–400. Chen and Olynyk noted that the greatest percentage increase in sweep efficiency occurred at the most adverse mobility ratios. A similar increase in areal sweep efficiency was noted for horizontal well injections of carbon dioxide versus point-source injection from vertical wells. See Jones, S. E., "Effects Of Horizontal Wellbore Injection Versus Point-Source Injection On The Recovery Of Oil By $CO_2$," U.S. Department of Energy Report No. DOE/MC/21207-T23, May 1986.

A related process is described in copending U.S. patent application Ser. No. 140,519, filed 1-4-1988, our Docket No. 78,780. The disclosed process injects a solvent through a horizontal well to form a solvent curtain falling through the reservoir. Hydrocarbons banked below the solvent curtain are produced from the bottom of the reservoir.

SUMMARY OF THE INVENTION

The invention is a method for recovering residual hydrocarbons from a reservoir which has been previously swept by gas. The invention steps comprise drilling and completing at least one horizontal injection well relatively near the top of the reservoir and relatively near a substantially vertically oriented boundary of the reservoir, drilling and completing at least one second injection well between the horizontal injection well and the vertical boundary of the reservoir, injecting a miscible hydrocarbon solvent through the horizontal injection well to create a curtain of solvent falling through the previously gas swept reservoir, and injecting a drive fluid into the reservoir through the second injection well to drive the curtain of falling solvent horizontally through the reservoir. A production well is employed to produce hydrocarbons and other fluids that have been banked in front of the horizontally driven falling solvent curtain.

BRIEF DESCRIPTION OF THE DRAWINGS

FIG. 1 is a top sectional view of a small vertical reef reservoir penetrated injection well and several vertical wells needed to practice the invention.

FIG. 2 illustrates a side view along line 2—2 of FIG. 1 which further illustrates the falling curtain of solvent over successive time periods.

FIG. 3 is a top view of the reservoir of FIG. 1 which further illustrates alternate horizontal well injection patterns.

DETAILED DESCRIPTION

The recovery of residual oil from a reservoir which has been previously gas flushed presents major technical and economical problems. In such reservoirs, the oil saturation is relatively near residual oil saturation to gas. The portion of the reservoir which has been swept by gas is frequently referred to as a secondary gas cap.

The solvents required for miscible flooding usually have a substantially greater density than the in-place gas that is left behind in a secondary gas cap. Thus, if a miscible solvent is injected into the secondary gas cap the injected solvent tends to fall quickly through the reservoir and fails to achieve significant areal coverage. The injected solvent falls in a relatively small area around vertical injection wells, in a 100 to 500 foot diameter cylinder at best. Thus, the use of vertical injection wells to inject solvent in a reservoir previously gas flooded results in the solvent quickly falling through the reservoir, leaving behind swept areas resembling small diameter vertical chimneys. The number of vertical injection wells required to sweep residual oil from such a reservoir cannot be supported economically by the produced oil.

There are a substantial number of candidate reservoirs to which the present invention may be applied to recover significant amounts of residual oil. Many of these previously gas flushed reservoirs are vertical reef reservoirs in Western Canada that have a substantial vertical thickness and are generally well bounded. They range in size from large vertical reservoirs such as the Bonnie Glen Reservoir in Alberta, Canada which measures $7\frac{1}{2}\times3\frac{1}{2}$ miles to small pinnacle reef reservoirs which may be 5 to 20 acres in size and contain only one well. Although this invention may be used in reservoirs of all sizes, it is particularly well suited for vertical reef reservoirs having a substantial vertical thickness.

Because of the large density difference between gas and residual oil fluids left in the gas flushed zone and the miscible flooding solvent, injection of miscible solvent into a horizontal well results in the solvent falling in a curtain or sheet over the length of the horizontal injection well. Previously gas flushed reservoirs are swept according to the invention method by dropping a curtain of miscible solvent through the reservoir from a horizontal injection well and driving the solvent curtain horizontally through the reservoir with a drive fluid as the solvent is falling in a vertical direction. This achieves areal sweep by the solvent in all three dimensions within the reservoir.

Assuming a substantially homogeneous reservoir matrix, the solvent should sweep the area of the reservoir below it in a curtain with a width of several hundred feet. The solvent curtain will gradually widen as it falls farther below the horizontal injection well. Preferably, the solvent will be injected from perforations in the sides or top of the horizontal injection well. Perforations on the bottom of the horizontal well will result in a smaller areal sweep.

The horizontal injection well should be completed at or relatively near the top of the swept reservoir and relatively near a substantially vertically oriented boundary of the reservoir. This boundary should be relatively impermeable to fluid flow. Thus, the horizontal injection well and the vertically oriented boundary of the reservoir will bound an area into which a drive fluid may be injected to drive the falling solvent curtain horizontally through the reservoir.

One or more second injection wells are drilled and completed between the horizontal injection well and the vertical boundary of the reservoir. As the miscible hydrocarbon solvent is falling through the reservoir in a curtain, a drive fluid is injected into the reservoir through the one or more second injection wells in a quantity sufficient to drive the curtain of falling solvent horizontally through the reservoir. At least one production well is placed on the opposite side of the horizontal injection well from the second injection well to produce hydrocarbons and other fluids that have been banked in front of the horizontally driven falling solvent curtain. This production well or wells may be a vertical or horizontal well.

A multiple number of horizontal injection wells may be employed to inject the miscible solvent. In fact, a number of horizontal injection wells will be required unless the reservoir is relatively small. Two preferred embodiments of multiple horizontal injection wells include a parallel arrangement of closely spaced horizontal wells or a staggered parallel arrangement in order to drop a thicker curtain of solvent through the reservoir. These embodiments further insure the integrity of the solvent bank and substantially reduce the likelihood of drive fluid breaking through the solvent curtain. The horizontal injection wells may also be arranged in X-shaped patterns, curved figures, or any other pattern which could be reasonably believed to sweep the formation as solvent falls below the horizontal injection wells.

The second injection well for the drive fluid may be a vertical or a horizontal well. If the amount of recoverable oil is sufficient, a horizontal injection well is preferred to inject the drive fluid. A horizontal injection well is more likely to push the drive fluid through the reservoir in an even front, which would evenly drive the miscible solvent curtain through the reservoir. Because injected fluid spreads out from vertical injection wells in a radial fashion, the use of only one or two vertical injection wells will result in an uneven front of drive fluid and a generally uneven movement of the miscible solvent curtain through the reservoir.

The invention requires the use of a solvent which is miscible in some fashion, first contact miscible or multiple contact miscible with the residual oil and gas in the gas flushed region of the reservoir. Such a solvent could be an alkane having about 2 to about 10 carbon atoms, preferably ethane, propane, and butane or a mixture of such, naphtha, kerosene, carbon dioxide, a mixture of carbon dioxide and nitrogen, or mixtures thereof. The drive fluid should be a material which is less expensive than the solvent. Preferably, the drive fluid is natural gas, water, nitrogen, air, carbon dioxide, or mixtures thereof. If produced gas from the reservoir is recycled as a drive fluid, a lean gas is especially preferred.

The cost of injecting a drive fluid can be significantly reduced by producing gas from the secondary gas cap in front of the solvent curtain and reinjecting that gas as the drive fluid or a portion of the drive fluid. This lowers reservoir pressure horizontally in front of the solvent curtain and provides a horizontal driving force for the solvent. This driving force is increased by reinjecting such produced gas into the second injection well or wells as drive fluid. It is most preferred to separate the heavier components out of the produced gas and reinject the remaining "lean gas" as all or a portion of the drive fluid.

An additional option for reducing flood costs is to produce at least a portion of the miscible solvent curtain for recovery or reinjection. As the solvent curtain is displaced through the reservoir, the curtain will tend to drain or slump downward due to gravitational forces. Because of this slumping, the solvent may become overly concentrated at the bottom of the reservoir and fail to sweep the top portion of the gas flushed zone. Production of a portion of the solvent curtain by horizontal or vertical production wells placed relatively near the bottom of the reservoir can recover this excess solvent from the bottom of the reservoir.

Once the sweep effectiveness of the solvent curtain has been sufficiently diminished due to gravitational slumping, it is preferred to inject additional miscible solvent through the use of one or more additional horizontal injection wells. These additional horizontal injection wells should also be placed relatively near the top of the reservoir and located horizontally from the original horizontal injection well in the direction of the flood. This process may be repeated as required as the solvent curtain is displaced through the reservoir. Most preferably, all or a portion of the additional injected solvent will be solvent produced from the bottom of the reservoir.

FIGS. 1 and 2 illustrate top and side views of a small vertical reef reservoir. FIG. 3 is a top sectional view of a vertical reef reservoir showing different options for horizontal solvent injection wells and drive fluid injection wells. These figures are not drawn to scale.

In FIGS. 1-3, vertical reef reservoir 10 is shown penetrated by horizontal injection well 17, vertical injection well 18, vertical solvent production well 19, and vertical production well 20. The side view of FIG. 2 illustrates the original gas cap 11, the secondary gas cap 12 which is the oil zone previously swept by a gas flood, an oil layer 13, and aquifer 14. The vertically oriented boundary 15 is shown on the end of the reservoir 10 near vertical injection well 18. Wellheads 25, 26, 27, and 28 are illustrated for wells 17, 18, 19, and 20, respectively.

FIG. 2 illustrates the falling solvent curtain as shaded area 21 created by the injection of miscible solvent through horizontal well 17. The injection of drive fluid through vertical well 18 will tend to push the falling solvent curtain 21 horizontally through the reservoir. After the lapse of a period of time, the falling solvent curtain 21 will tend to slump and will advance horizontally through the reservoir to the position of shaded solvent curtain 22. After an additional period of time, the solvent curtain will fall and advance to become solvent curtain at shaded area 23.

Vertical production well 19 with wellhead 27 can be used to produce the solvent for reinjection into the reservoir or recover it for some other use. Preferably, additional solvent will be injected into the reservoir through one or more additional horizontal injection wells before the solvent curtain slumps to the position noted at solvent curtain 23. Vertical production well 20 with wellhead 28 is preferably placed at one end of the reservoir to recover hydrocarbons and other fluids from the reservoir that have been banked in front the horizontally driven falling solvent curtain. Additional production wells may be placed throughout the reservoir to recover hydrocarbons.

FIG. 3 illustrates injection well options which may be employed in the invention process. Horizontal injection well 31 may be substituted for vertical injection well 18 to inject the drive fluid. Horizontal injection wells 32, 33, and 34 offer another alternative which may be used to inject solvent or drive fluid instead of a single long horizontal injection well 17 or 31. A series of horizontal injection wells must be employed when the width of the reservoir is substantially greater than the length to which a horizontal injection well can be practically used. Another option is to use two staggered rows of horizontal injection wells illustrated as injection wells 35, 36, 37, and 38. Multiple horizontal wells 41, 42, 43, and 44 may also be whipstocked off a single multiple hole 45. This type of arrangement allows for the drilling of multiple horizontal injection or production wells from a single well pad, resulting in a lower cost per horizontal well.

The diameter and length of the horizontal wells and their perforation intervals are not critical, except that such factors will affect the well spacing and the economics of the process. Optimum well spacing may vary considerably from formation to formation and may depend upon many factors known to those skilled in the art. It is not necessary that the well spacings in a particular pattern be equal. Such decisions should be determined by conventional drilling criteria, the characteristics of the specific formation, the economics of a given situation and the well known art of drilling horizontal wells.

Such horizontal wells must extend from the surface and run a substantially horizontal distance within the hydrocarbon formation. The optimum number of horizontal wells and their distance from each other and from other vertical wells which may also be employed is a balance of economic criteria. Perforation size will be a function of other factors such as flow rate, temperatures and pressures employed in a given operation.

Many other variations and modifications may be made in the concepts described above by those skilled in the art without departing from the concepts of the present invention. Accordingly, it should be clearly understood that the concepts disclosed in the description are illustrative only and are not intended as limitations on the scope of the invention.

What is claimed is:

1. A method for recovering residual hydrocarbons from a reservoir having a substantial vertical thickness and an oil saturation relatively near residual oil saturation to gas, which comprises:

drilling and completing at least one horizontal injection well relatively near the top of the reservoir and relatively near a substantially vertically oriented boundary of the reservoir, said boundary being relatively impermeable to fluid flow;

drilling and completing a second injection well between the horizontal injection well and said vertical boundary of the reservoir;

injecting a miscible solvent into the reservoir through the horizontal injection well to create a curtain of solvent falling through the reservoir;

injecting a drive fluid into the reservoir through the second injection well in a quantity sufficient to drive the curtain of falling solvent horizontally through the reservoir; and producing through at least one production well hydrocarbons and other fluids that have been banked in front of the horizontally driven falling solvent curtain.

2. The method of claim 1, further comprising the use of multiple horizontal injection wells.

3. The method of claim 2, wherein the multiple horizontal injection wells are substantially parallel.

4. The method of claim 1, further comprising the use of a plural number of second injection wells to inject drive fluid into the formation.

5. The method of claim 4, wherein the second injection well is a horizontal well.

6. The method of claim 4, wherein the second injection well is a vertical well.

7. The method of claim 1, wherein the miscible solvent is an alkane having about 2 to about 10 carbon atoms, naphtha, kerosene, carbon dioxide, a mixture of carbon dioxide and nitrogen, or mixtures thereof.

8. The method of claim 1, wherein the drive fluid is natural gas, water, nitrogen, air, carbon dioxide, or mixtures thereof.

9. The method of claim 1, further comprising producing at least a portion of the miscible solvent from the horizontally driven solvent curtain and reinjecting that produced solvent into the formation.

10. The method of claim 1, wherein the production well is a horizontal well.

11. The method of claim 1, wherein the production well is a vertical well.

12. The method of claim 1, further comprising producing hydrocarbons and other fluids from the reservoir through a production well located horizontally in front of the horizontally driven falling solvent curtain.

13. The method of claim 12, further comprising reinjecting the produced gas from the reservoir into the reservoir as the drive fluid.

14. The method of claim 13, further comprising separating heavier components out of the produced gas and reinjecting the remaining lean gas as the drive fluid.

15. The method of claim 1, wherein the horizontal injection well is perforated on the sides of the horizontal well.

16. A method for recovering residual hydrocarbons from a reservoir having a substantial vertical thickness and an oil saturation relatively near residual oil saturation to gas, which comprises:

drilling and completing multiple horizontal injection wells relatively near the top of the reservoir and relatively near a substantially vertically oriented boundary of the reservoir, said boundary being relatively impermeable to fluid flow;

drilling and completing multiple vertical injectinn wells between the horizontal injection wells and said vertical boundary of the reservoir;

injecting a miscible solvent into the reservoir through the horizontal injection wells to create a curtain of solvent falling through the reservoir;

producing gas from the reservoir through at least one production well located horizontally in front of the falling solvent curtain;

reinjecting the produced gas from the reservoir into the vertical injection wells as a drive fluid in a quantity sufficient to drive the curtain of falling solvent horizontally through the reservoir; and producing through at least one production well hydrocarbons and other fluids that have been banked in front of the horizontally driven falling solvent curtain.

17. The method of claim 16, further comprising injecting gas through the vertical injection wells to supplement the produced and reinjected gas as a drive fluid.

* * * * *